United States Patent [19]

Anzawa et al.

[11] Patent Number: 4,931,108

[45] Date of Patent: Jun. 5, 1990

[54] METHOD OF HEAT TREATMENT OF ROLLED STEEL MATERIAL USING FOAMS IMPREGNATED WITH WATER SOLUBLE POLYMERS

[75] Inventors: Norio Anzawa; Hisashi Yazaki; Kozi Adachi; Naoki Watanabe; Shuichi Miyabe, all of Muroran; Kozo Kitazawa, Wakayama, all of Japan

[73] Assignee: Nippon Steel Corporation, Tokyo, Japan

[21] Appl. No.: 210,581

[22] PCT Filed: Sep. 4, 1987

[86] PCT No.: PCT/JP87/00660

§ 371 Date: Jun. 30, 1988

§ 102(e) Date: Jun. 30, 1988

[87] PCT Pub. No.: WO88/01652

PCT Pub. Date: Mar. 10, 1988

[30] Foreign Application Priority Data

| | | | |
|---|---|---|---|
| Apr. 6, 1987 | [JP] | Japan | 62-82990 |
| Apr. 13, 1987 | [JP] | Japan | 62-88876 |
| Sep. 4, 1987 | [JP] | Japan | 61-206716 |

[51] Int. Cl.[5] ..... C21D 1/48; B23K 35/24

[52] U.S. Cl. ..... 148/18; 148/28; 148/143; 148/146; 148/147; 148/153

[58] Field of Search ..... 148/143, 146, 147, 153, 148/18, 28

[56] References Cited

U.S. PATENT DOCUMENTS

| | | | |
|---|---|---|---|
| 2,910,395 | 10/1959 | Cox, Jr. | 148/18 |
| 4,087,290 | 5/1978 | Kopieitz | 148/18 |
| 4,404,044 | 9/1983 | Warchol | 148/18 |
| 4,528,044 | 7/1985 | Warchol | 148/18 |
| 4,738,731 | 4/1988 | Foreman et al. | 148/18 |

FOREIGN PATENT DOCUMENTS

| | | | |
|---|---|---|---|
| 1198892 | 1/1986 | Canada | 148/18 |

*Primary Examiner*—Upendra Roy

*Attorney, Agent, or Firm*—Wenderoth, Lind & Ponack

[57] ABSTRACT

The present invention provides a method for cooling a rolled steel material, especially a wire rod, which comprises immersing a hot-rolled steel material in foams obtained by adding a blowing agent to water, which foams have a water content of 0.01 to 80 g/100 ml, to cool the steel material by the foams. According to this method, a product having a good quality can be stably obtained by a uniform cooling.

6 Claims, 5 Drawing Sheets

METHOD OF HEAT TREATMENT OF ROLLED STEEL MATERIAL USING FOAMS IMPREGNATED WITH WATER SOLUBLE POLYMERS

TECHNICAL ART

The present invention relates to a method for the heat treatment of a rolled steel material. More particularly, the present invention relates to a method in which, subsequent to the hot rolling step, a hot-rolled steel material, especially a wire rod, is cooled while supplying a cooling medium such as a surface active agent to the hot-rolled steel material.

In the hot-rolling process for the production of a wire rod, a bar, a section, a sheet, a strip, a pipe or the like, the present invention is effectively applied to the cooling of a hot-rolled steel material.

BACKGROUND ART

As the method for heat-treating a high-temperature steel material subsequent to the hot-rolling step by rapid cooling or gradual cooling, there are known, for example, in the case of a wire rod, a method in which air, mist, water or the like is sprayed onto a hot steel material, a method in which a hot steel material is immersed in a metal bath of salt or lead, a method in which a hot steel material is immersed in a liquid such as warm water, cold water or oil, and a method in which a hot steel material is immersed in a fluidized and stirred warm liquid, as shown in Japanese Unexamined Patent Publication No. 57-9826. These methods are utilied according to the intended use, respectively, and although most of these methods are unifunctional, they have excellent characteristics. However, to cope with one of the requirements in the iron and steel production process, that is, multiple variety-small lot production, a plurality of cooling apparatus must be disposed, and thus the production process is complicated and the installation cost increased.

As a means for overcoming this disadvantage, there has been developed a multi-functional heat treatment system as introduced in the Journal of Japanese Association of Metallurgy, 25, 6 (1986), page 559. This system is characterized in that the air-blast method is adopted at a cooling speed lower than 10° C./sec and the immersion method is adopted at a cooling speed higher than 10° C./sec. The installation has a two-line structure of upper and lower lines, and a cooling medium-circulating apparatus is disposed in the lower line as the immersion line for cooling a hot steel material in the fluidized and stirred state. A temperature-maintaining cover and a blower are arranged in the air-blast line as the upper line. Each line obtains a desired cooling speed of 2° to 100° C./sec.

In a controlled cooling of a spring steel or high-carbon steel wire rod, especially a spring steel, if immersion cooling is carried out in hot water having a temperature close to the boiling point, the cooling speed is too high and a supercooled texture is formed, and if natural, gradual cooling in the open air is adopted, the cooling speed is not uniform and ferrite decarburization is caused in a portion where the cooling speed is low. Accordingly, an air-blast cooling method comprising blowing air onto a hot steel material is generally adopted as the means for obtaining an appropriate cooling speed at the immersion cooling in hot water and an intermediate cooling speed at the natural, gradual cooling in the open air. However, when a non-concentric wire ring coiled at a laying head is continuously placed and cooled on a conveyor, the lapping degree (density) of each ring is changed from the center of the ring toward both the side portions, and therefore, a measure is adopted for changing the air blast quantity according to the lapping degree of the ring. However, in the conventional method, wherein air is supplied from below, cooling is insufficient in the lapped portion of the ring and a uniform cooling cannot be attained, and the dispersion of the cooling speed in one ring is larger than the dispersion of the cooling speed in a material treated by immersion in hot water. Accordingly, the deviation of mechanical properties such as tensile strength is increased, and an adverse influence is imposed on the wear of a tool and dimension precision at the secondary processing, and a problem of an occurrence of bending at the straightening step arises.

As the cooling method for homogeneous patenting, there is known a method in which a hot steel material is immersed and cooled in a strongly stirred fluid medium comprising a gas and warm water. In this method, however, since the cooling medium is in the strongly stirred state, a fine wire having a diameter of about 5.5 mm is oscillated while supplied by a conveyor, and problems arise at the transfer step and a partial peeling of scale occurs, with the result that a roughening of the surface is caused at the mechanical descaling or pickling step. Furthermore, since a large quantity of air is blown, the running cost is increased because of the presence of a blower and a cooling medium-circulating apparatus is necessary, and therefore, the installation scale is increased and the system becomes complicated, and the equipment cost is drastically increased.

DISCLOSURE OF THE INVENTION

It is an object of the present invention to provide a new cooling method for eliminating the above-mentioned defects. More specifically, according to the present invention, the cooling state by air-blast and the cooling state by immersion in a strongly stirred cooling medium are obtained by supplying a hot steel material into foams having a water content of 0.01 to 80 g/100 ml, which are obtained by adding a blowing agent to water, and according to the method of the present invention, the steel material can be cooled more stably. Moreover, by forming foams by using a surface active agent or a water-soluble polymer, a desired cooling speed is easily attained and the deviation of the cooling speed is much more improved over the deviation of the cooling speed in the conventional cooling method.

BEST MODE FOR CARRYING OUT THE INVENTION

The present invention will now be described in detail with reference to the accompanying drawings.

Figure 1:
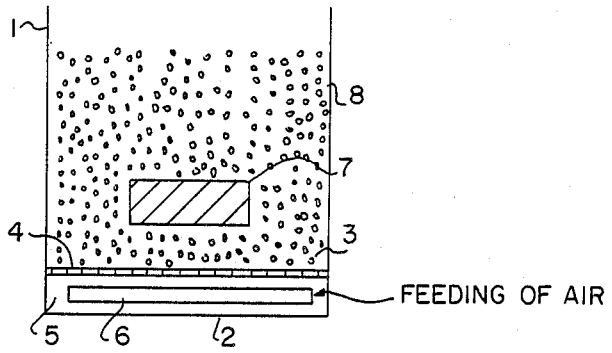
FIG. 1 is a sectional view illustrating an example of equipment for carrying out the present invention.

In the installation of the present invention shown in FIG. 1, a floor plate 4 having many fine holes 3 is arranged in the inner portion of the bottom side of a cooling bath 1, and an aqueous solution 5 containing a surface active agent or a water-soluble polymer is stored between this floor plate 4 and a bottom plate 2 of the cooling bath 1. A filter 6 is immersed in the aqueous solution 5.

By blowing a gas (air) into the filter 6, the aqueous solution 5 is foamed and foams 8 are blown out into the cooling bath 1 from the fine holes 3 of the floor plate 4 and the interior of the bath 1 is filled with foams. The following results were obtained by cooling a wire rod 7 by feeding the wire rod 7 into the foams.

Figure 2:
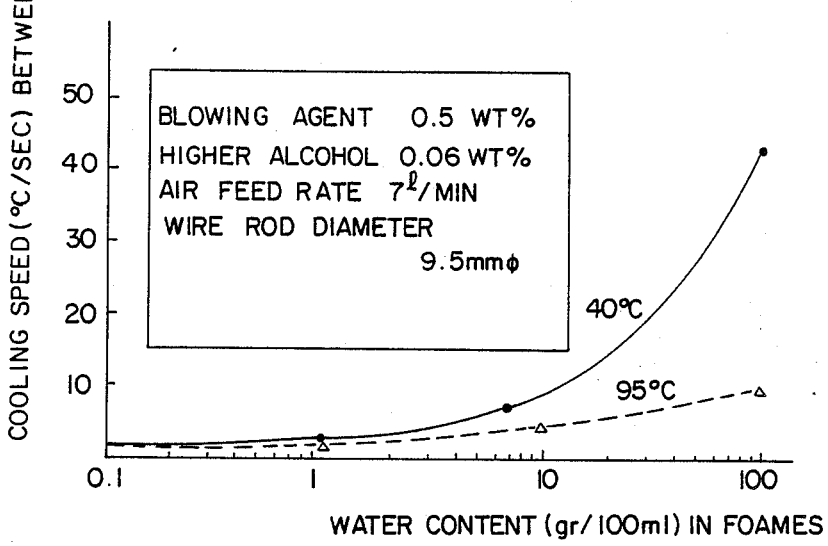
FIG. 2 is a diagram illustrating the cooling speed attained when the heat treatment is carried out according to the present invention.

More specifically, air was blown at a rate of about 7 l/min through the filter 6 into the aqueous solution 5 formed by adding 0.5% by weight of an anionic surface active agent and 0.06% by weight of a higher alcohol to 1 l of water at normal temperature, and a wire rod 7 having a diameter having a diameter of 9.5 mm and containing 0.4% of C, which was heated at 900° C., was immersed and cooled in the so-formed foams 8 and the cooling speed was measured. The obtained results are shown in FIG. 2. As is seen from FIG. 2, the cooling speed is increased with an increase of the water content in the foams. Furthermore, it is seen that the lower the temperature of the aqueous solution containing the blowing agent (such as a surface active agent or a water-soluble polymer), the higher the cooling speed (in FIG. 2, the solid line of marks o shows the results obtained when the temperature of the aqueous solution was 40° C. and the broken line of marks Δ shows the results obtained when the temperature of the aqueous solution was 95° C.). It is considered that these effects are due mainly to cooling by evaporation of the latent heat of water in the foams, that is, a boiling heat transfer.

Accordingly, the cooling speed can be freely controlled by adjusting the water content in the foams or the temperature of the aqueous solution containing the blowing agent, and the mechanical properties such as the tensile strength of the wire rod also can be controlled.

Foams can be formed according to the air-feeding method, the stirring method, the shaking method, the boiling method, the pressure-reducing method, the solubility-reducing method and the like. According to the air-feeding method, an inert gas such as air or $N_2$ or a reducing gas is blown into the aqueous solution containing the blowing agent through a nozzle or the like. For example, an injection nozzle is used for supplying a wire ring. The foam injection nozzle may be arranged above or below the wire ring or horizontally thereto, and a nozzle for supplying quenching cold water also can be used as the injection nozzle. In order to supply foams in a larger amount to the portion having a larger lapping density of the wire ring than to other portions, preferably, the foams are supplied from foam projection nozzles arranged convergently in the portion having a larger lapping density. A method also may be adopted in which foams having a higher water content are supplied to the portion of the wire ring having a larger lapping density, than to other portions.

The water content (blowing ratio) in the foams can be controlled according to the water-to-blowing agent ratio in the aqueous solution containing the blowing agent, the kind and concentration of the blowing agent and the quantity of air blown into the aqueous solution containing the blowing agent.

In the present invention, the lower limit of the water content in the foams is 0.01 g/100 ml, which is the critical water content at which a high-temperature wire rod can be continuously cooled by immersion in foams. In other words, if the water content in the foams is lower than 0.01 g/100 ml, the cooling speed is not influenced by the foams. The upper limit of the water content in foams, which is 80 g/100 ml, is based on the water content necessary for clearing the cooling speed of 10° to 30° C./sec attainable by immersion in a strongly stirred cooling medium in the conventional multi-functional system, with a certain allowance being taken into consideration. The water content in the foams can be controlled according to the kind and concentration of the blowing agent, the distance between the surface of the aqueous solution containing the blowing agent and the material to be cooled, the foam height, the air feed rate, and the kind of filter.

The foams used for cooling the wire rod are prepared from a surface active agent or a water-soluble polymer, and continuous cooling can be stably performed by using the foams. The control of the heat resistance, foam size and water content can be easily performed and the deviation of the cooling speed can be moderated by immersion cooling in hot water. The reason why such effects can be attained is that foams formed of a surface active agent or water-soluble polymer as the blowing agent completely cover a coil of the wire rod even in the portion having a larger lapping density of the wire ring, and therefore, the evaporation speed of water in the foams can be changed according to the dissipation heat quantity of the wire rod. Namely, the evaporation speed of water in the foams is increased in the portion having a larger lapping density of the wire ring, and the quantity of removed heat is increased.

The necessity for the surface active agent and water-soluble polymer will now be described.

When a surface active agent is used as the blowing agent, the surface active agent is adsorbed on the gas-liquid surface to reduce the surface tension and increase the surface viscosity, and the foaming property at the foam-forming step, the size or uniformity of foams, and the stability of the foams can be improved. If the water-soluble polymer is used, the polymer mainly improves the surface viscosity or surface viscoelasticity of the gas-liquid surface and forms stable foams.

Thus, if a surface active agent or a water-soluble polymer is used as the blowing agent, the formed foams are uniformalized and stabilized, and a layer of foams having a water content of 0.01 and 80 g/100 ml can be optionally prepared. If these foams are used for cooling a high-temperature wire rod, the cooling atmosphere can be easily controlled, and a wire rod having a good quality can be stably prepared.

A method may be considered in which foams are formed only by a mechanical force, for example, by force stirring, without using a blowing agent, but foams formed by this method have a high surface energy and a low surface viscosity and the foams are heterogeneous and have a poor stability. Accordingly, the atmosphere for cooling the wire rod is not kept constant and lot or quality deviations are caused, and it is difficult to obtain a stably prepared aimed wire rod having a good quality.

A surface active agent and/or a water-soluble polymer is used as the blowing in the present invention. The surface active agent and water-soluble polymer will now be described in detail.

By the surface active agent referred to in the present invention is meant a water-soluble organic compound which is adsorbed on the gas-liquid surface to reduce the surface activity. As the surface active agent, there can be mentioned an anionic activator, a cationic activator, a non-ionic activator and an amphoteric activator, and these activators are used for obtaining stable foams. More specifically, as the anionic activator, there can be mentioned fatty acid salts, higher alcohol sulfuric acid esters, liquid fatty acid sulfuric acid ester salts, aliphatic amine and aliphatic amide sulfuric acid salts, aliphatic alcohol phosphoric acid ester salts, sulfonic acid salts or dibasic fatty acid esters, fatty acid amide sulfonic acid salts, alkylaryl sulfonic acid salts and formalin-condensed naphthalene sulfonic acid salts. These anionic activators are characterized in that the blowing power is large. As the cationic activator, there can be used aliphatic amine salts, quaternary ammonium salts and alkyl pyridinium salts. As the non-ionic activator, there can be mentioned polyoxyethylene alkyl ethers, polyoxyethylene alkylphenol ethers, polyoxyethylene alkyl esters, sorbitol alkyl esters and polyoxysorbitol alkyl esters. The non-ionic activators cause blowing in salt-dissolved water without being influenced by ions. As the amphoteric activator, there can be mentioned alkyl betaines, alkyl dimethylamine oxides and alkyl alanines. These amphoteric activators are characterized in that they form stable foams without being influenced by ions. The above-mentioned four kinds of the activators can be used as the surface active agent, but the surface active agents that can be used in the present invention are not limited to these activators.

For a formation of foams, at least one member selected from the above-mentioned surface active agents is preferably added to water in an amount of 0.001 to 40%.

As the water-soluble polymer, there can be mentioned natural, synthetic and semi-synthetic water-soluble polymers. More specifically, there can be used corn starch, starches, glue, sodium alginate, gum arabic, tragacanth gum, yam, aloe, devil's-tongue, funorin, casein, gelatin, albumen, plasma protein, pullulan, dextrin, carboxystarch, British gum, dialdehyde starch, cation starch, viscous rayon, methyl cellulose, ethyl cellulose, carboxymethyl cellulose, hydroxyethyl cellulose, polyvinyl alcohol, polyethylene glycol, polyalkylene glycol, polyacrylamide, polyacrylic acid, polyvinyl pyrrolidone, water-soluble alkyd polyvinyl ether, polymaleic acid copolymer, polyethylene-imine and saponin, although the water-soluble polymers that can be used in the present invention are not limited to those mentioned above.

For a formation of foams, preferably at least one member selected from the above-mentioned water-soluble polymers is added to water in an amount of 0.1 to 30%.

A mixture comprising the above-mentioned surface active agent and water-soluble polymer at an optional ratio can be used. In order to improve the properties and stability of foams, an appropriate amount of a chelating agent, a builder, a higher alcohol or the like may be added to an aqueous solution of a surface active agent or a liquid mixture of a surface active agent and a water-soluble polymer.

As the chelating agent, there can be mentioned, for example, salts of aminocarboxylic acids such as dihydroxyglycine, hydroxyethyliminodiacetic acid, nitrilotriacetic acid, hydroxydiethylethylenediaminetriacetic acid, ethylenediamine-tetraacetic acid and dientylenetriamineheptaacetic acid, salts of hydroxycarboxylic acids and polycarboxylic acids such as sodium citrate, sodium gluconate and sodium tartrate, phosphonic acids such as hydroxuethane-diphosphonic acid, nitrirotrismethylene-phosphonic acid and ethylenediaminetetramethylene-phosphonic acid, and salts of condensed phosphonic acids such as sodium tripolyphosphate and sodium pyrophosphate. Preferably at least one member selected from these chelating agents is used in an amount of 0.001 to 20%.

Primary and secondary alcohols having 6 to 36 carbon atoms are preferred as the higher alcohol. At least one member selected from hexanol, octanol, lauryl alochol, myristyl alcohol, cetyl alcohol, stearyl alcohol, oleyl alcohol and Guerbet alcohols having 18, 24 or 36 carbon atoms may be added in an amount of 0.5 to 30% based on the surface active agent.

Furthermore, a builder such as sodium silicate, sodium sulfate or sodium carbonate may be added in an amount of 0.1 to 30% based on the above-mentioned composition.

In general, the aqueous solution containing the blowing agent is used at a temperature in the range of from 0° to 100° C., but from the energy-saving viewpoint, preferably a desired cooling speed is obtained at a normal temperature by controlling the water content in foams. A method may be adopted in which the gas to be blown is preliminarily heated.

The cooling method of the present invention using the blowing agent can be easily attached to the existent equipment. In the conventional air-blast cooling method (Stelmore), a method can be adopted in which a foaming nozzle is connected to an existent air blast-supply duct, a damper is attached to prevent foams from returning to the blower side, and foams are supplied from the air blast nozzle to effect cooling.

In the conventional hot water immersion method (EDC), foam cooling can be performed by attaching a foam supply header tube between the side guide and the bottom plate of the tank and supplying foams through this tube.

Foams supplied to the rolled steel material cover the surface of the steel material completely. The aqueous solution of the film of foams covering the surface of the steel material is evaporated by heat retained by the steel material and the steel material is cooled mainly by the boiling heat transfer.

The surface active agent in foams is adsorbed on the gas-liquid surface to reduce the surface tension and increase the surface viscosity, whereby the foaming property at the foam-forming step and the size, uniformity and stability of the foams are improved. The water-soluble polymer in the foams improves the surface viscosity or surface viscoelasticity of the gas-liquid surface and forms stable foams.

The flowability of the foams and the evaporation heat quantity per unit volume are changed according to the amount of the aqueous solution in the foams, and therefore, if the amount of the aqueous solution is changed, the cooling speed is also changed. Furthermore, the amount of heat removed from the hot steel material is changed according to the amount of foams covering the surface of the hot steel material. The foams falling in contact with the hot steel material are extinguished by evaporation by heat retained by hot steel material. If the amount of foams supplied to the surface of the hot steel material, that is, the foam supply rate, is changed, the cooling speed is also changed.

As apparent from the foregoing description, the cooling speed can be adjusted by changing the amount of the aqueous solution in foams or the foam supply rate, and the cooling speed can be adjusted over a broader range by changing both the amount of the aqueous solution in the foams and the foam supply rate.

The adjustment range of the cooling speed will now be described in detail.

In order to obtain a cooling speed higher than 10° C./sec by the foam immersion cooling, it is necessary to lower the temperature of foams and increase the water content. In this case, the cooling speed is greatly influenced by the water content in the foams, and where cooling is performed at a constant cooling speed higher than 10° C./sec, a precise control of the water content is necessary. Furthermore, in the case of a wire rod having a diameter of 10 mm, the upper limit of the cooling speed is set at about 50° C./sec.

Figure 3:
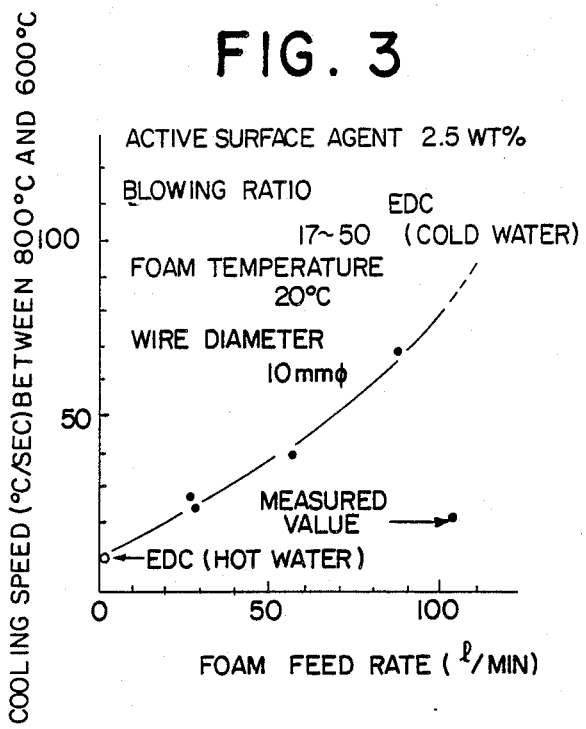
FIG. 3 is a diagram illustrating the relationship between a foam-supplying rate and a cooling speed in the present invention.

In contrast, in the foam injection cooling method, a cooling speed of about 7 to about 25 times the cooling speed attainable in the immersion method can be easily obtained at a blowing ratio (foam volume/volume of the aqueous solution) of 17 to 50 (the water content in foams is 6 to 2 gr/100 ml), as shown in FIG. 3, although the cooling speed is changed to some extent according to the foam supply rate.

Accordingly, as the cooling method where a cooling speed of at least 10° C./sec is necessary, the foam injection cooling method is advantageous because the control is easy and an obtainable upper limit value is large. Moreover, the proportion of supercooling in the direct impinging portion is much smaller than in the water-cooling method, and therefore, at the subsequent immersion cooling step, the cooling efficiency is selectively increased in the impinging portion where the surface temperature has been lowered. Accordingly, the proportion of supercooling is not increased and a uniform cooling is easily accomplished. Namely, since water seepage is not caused on cooling of a steel sheet, for example, on cooling on a hot run table in the hot-rolling process, a uniform cooling can be easily accomplished in this field.

The cooling capacity can be optionally adjusted by changing the blowing ratio in the range of natural, gradual cooling in the air to water injection cooling or controlling the injection amount from the nozzle (the injection speed).

More specifically, a cooling speed close to the cooling speed attained by gradual cooling in the air can be attained by increasing the blowing ratio, reducing the injection speed, and performing an immersion cooling in foams. In contrast, a cooling speed close to the cooling speed attained by water injection cooling can be attained by increasing the water content in foams, the foam supply rate, and the foam injection speed.

Figure 4:
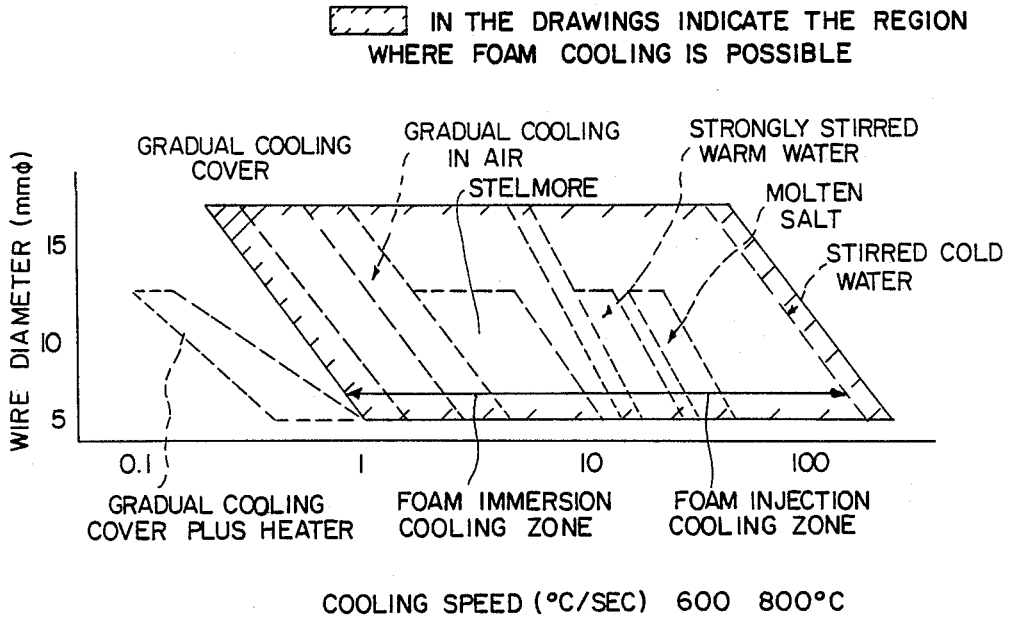
FIG. 4 is a diagram illustrating the controllability of the cooling speed in the present invention.
Figure 5:
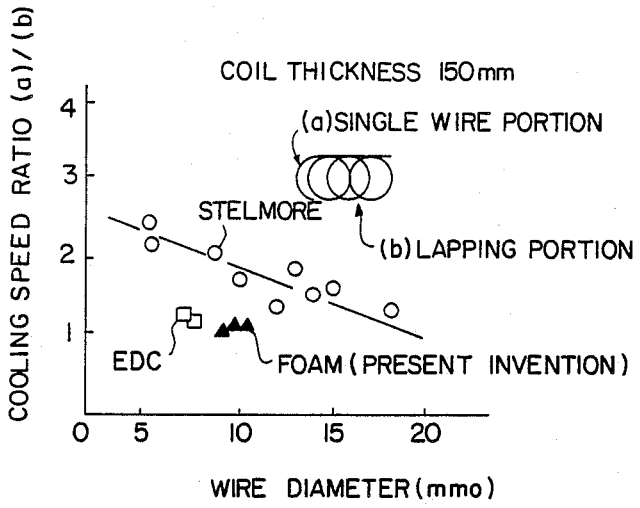
FIG. 5 is a diagram comparing the present invention with the conventional methods (EDC and Stelmore) with respect to the uniform cooling efficiency.

As seen from FIG. 4, illustrating preferred application ranges of the foam immersion cooling and injection cooling, preferably immersion cooling is adopted to obtain a cooling speed attained by gradual cooling in the air or hot water immersion in the conventional method, and injection cooling is performed when a higher cooling speed is necessary.

Since foams have an excellent flowability, in the method where a wire ring is cooled while delivering the ring by a conveyor, and the extinction of foams is more conspicuous in the portion where the lapping density of the wire is large, that is, the portion having a large radiation heat quantity, than in other portions, foams filled in the cooling bath naturally flow more vigorously to the extinction-conspicuous portion, and as a result, in the case of foam cooling, the cooling speed ratio between the lapped portion (b) and the single wire portion (a) in the wire rod is substantially 1. Accordingly, the present invention greatly improves uniform cooling effect over the conventional air-blast cooling or hot water immersion cooling method.

Accordingly, in the method of the present invention, the cooling speed obtained in the conventional method by natural, gradual cooling in the air, air-blast cooling, hot water immersion cooling, cooling by a strongly stirred fluid of a gas and warm water, salt cooling, cold water immersion cooling, and water injection cooling can be obtained by using only one cooling medium (foams), and the method of the present invention has a highly improved cooling uniformity compared to the conventional method.

It has been illustrated that the present invention is effective for steel materials, but the present invention is similarly effective for other metal materials involving similar problems.

EXAMPLE 1

The first embodiment using a cooling apparatus shown in FIG. 1 will now be described in detail.

An aqueous solution containing 0.5% by weight on an anionic surface active agent and 0.06% by weight of a higher alcohol, which was heated at about 95° C., was stored between a floor plate 4 and a bottom plate 2 in a cooling bath 1, and a filter 6 having a hole diameter of about 1 to about 5μ was immersed in the aqueous solution. Air was fed to the filter 6 at a rate of 7 l/min and foams 8 having a diameter of about 1 to about 3 mm were filled to a height of about 250 mm in the cooling bath. After this preparing operation, a wire rod 7 having a diameter of 9.5 mm, which was heated at about 900° C., was immersed and cooled in the aqueous solution. In order to reduce the deviation of the cooling speed and cool the wire rod with foams having a constant water content of about 10 g/100 ml, the distance between the surface of the aqueous solution containing the blowing agent and the wire rod was adjusted to about 50 mm, and to maintain the state where the high-temperature wire rod was completely immersed in the foams, air was continuously fed to the filter at a constant rate.

Figure 6:
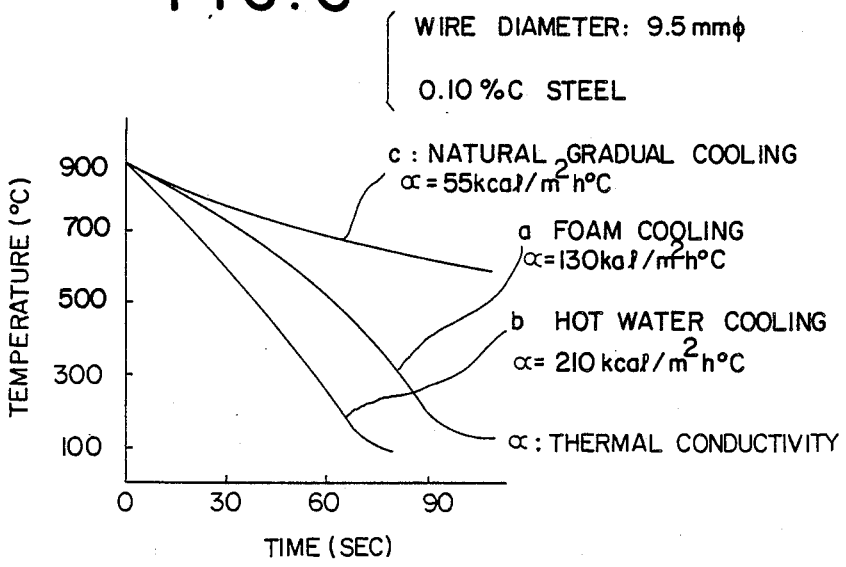
FIG. 6 is a diagram illustrating the cooling curve obtained when the heat treatment is carried out according to the present invention.

When cooling was thus effected with the foams according to the present invention, a cooling curve (a) shown in FIG. 6 was obtained, and cooling by immersion in hot water, indicated by a cooling curve (b), and natural, gradual cooling in the open air, indicated by a cooling curve (c).

As apparent from the foregoing description, air is generally used as the gas to be blown into the cooling bath, but to prevent a surface oxidation of the cooled wire rod, an inert gas such as $N_2$ gas or a reducing gas can be used. In the present example, foams were formed according to the air-feeding method comprising feeding air through a filter having holes having a certain diameter. Instead of this method, however, there can be adopted the stirring method, the shaking method, the boiling method, the pressure-reducing method, the solubility-reducing method, and a combination of two or more of these methods, and the foam-forming method is not particularly critical in the present invention. Furthermore, there may be adopted a method in which desired foams are formed outside the cooling tank and are then fed into the cooling tank.

EXAMPLE 2

Figure 7:
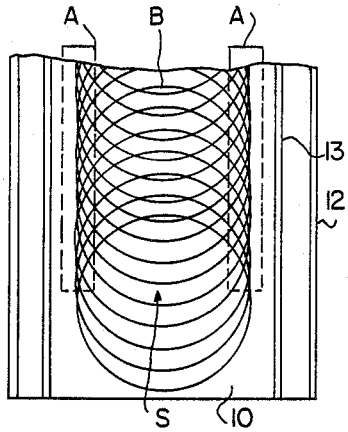
FIG. 7 is a plane view illustrating the state wherein wire rings are transferred on a conveyor.
Figure 8:
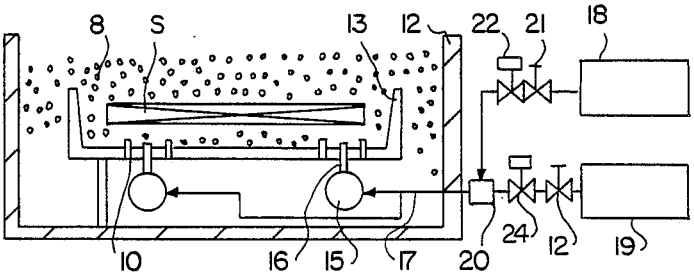
FIG. 8 is a view showing the longitudinal section of an example of cooling equipment for carrying out the present invention.

A second embodiment of the present invention is illustrated in FIG. 7, which is a plane view showing the state where wire rings are delivered on a conveyor, and FIG. 8 which is a longitudinally sectional view of the cooling equipment.

A hot-rolled wire rod is fed in the form of a ring onto a conveyor 10 from a laying head (not shown) of a winder to form wire rings S on the conveyor 10. In the wire rings S, the lapping density is higher in the portion A close to the side end then in the other portion B.

The conveyor 10 is contained in a channel 12 and side guides 13 are arranged on both sides. A header 15 is arranged just below the conveyor 10, and foam-injecting nozzles 16 are attached at points close to both ends of the header 14. The foam-injecting nozzles 16 are directed to both end portions A of the wire rings S. An aqueous solution bath 18, storing therein an aqueous solution containing a blowing agent and an air tank 19 connected to a foam-forming blower 20 are connected to the header 15 through a supply tube 17.

A stop valve 21 and a flow rate-adjusting valve 22 are arranged between the aqueous solution tank 18 and the blower 20, and a stop valve 23 and a pressure-adjusting valve 24 are arranged between the air tank 19 and the blower 20.

In the cooling equipment having the above-mentioned structure, if the aqueous solution is blown into the foam-forming blower 20 together with air, the aqueous solution is foamd and foams 8 are injected toward both end portions A of the wire rings S from the foam-injecting nozzles 16. The injected foams 8 are expanded not only to both end portions A but also throughout the channel 12 and the channel 12 becomes filled with foams 8. The wire rings S are cooled whole immersed in the foams 8.

In the present example, an aqueous solution formed by adding 2.5% by weight of an anionic surface active agent to 1 l of water and air introduced into the foam-forming blower at rates of about 10 l/min and about 200 l/min, respectively, to form foams. A wire rod containing 0.4% of C and having a diameter of 9.5 mm, which was heated at 900° C., was immersed and cooled in the so-formed foams. The wire rod was uniformly cooled, and a wire rod having an aimed quality could be stably prepared with a reduced quality deviation and a reduced lot deviation.

Separately, foams were formed by blowing air having a pressure of 1 kg/cm$^2$ at a rate of about 3000 l/min while feeding an aqueous solution formed by adding 1.0% by weight of an anionic surface active agent to 1 l of water at a flow rate of about 100 ml/min, whereby foams were formed. A spring steel wire rod having a diameter of 9.5 mm was immersed and cooled in these foams at a finish temperature of 850° C. and a conveyor speed of 15 m/min. The wire rod was uniformly cooled at an aimed cooling speed of 8° C./sec, and a wire rod having an aimed quality could be stably prepared without formation of a supercooled texture or an occurrence of ferrite decarburization.

Figure 9:
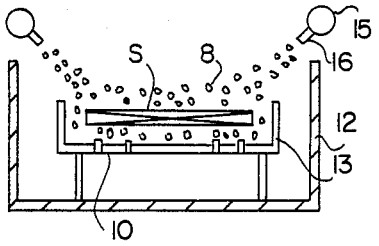
FIGS. 9, 10 and 11 are longitudinally sectional view showing other examples of the cooling equipment of the present invention.
Figure 10:
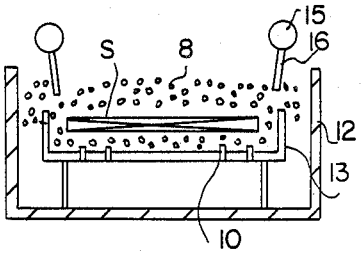

FIGS. 9 and 10 illustrate other examples of the cooling equipment for carrying out the second embodiment of the present invention. The same members as the members shown in FIG. 8 are indicated by the same reference numerals as used in FIG. 8 and a detailed description of these members is omitted. The aqueous solution tank, air bath, and foam-forming blower shown in FIG. 8 are omitted and not shown in FIGS. 9 and 10.

As shown in FIG. 9, the header 15 is arranged just above the channel 12, and the foam-injecting nozzles 16 are inclined so that they are directed toward the side end portions A of the wire rings S. Foams 9 are supplied only to the interior between the side guides 13. In FIG. 10, the header 15 is arranged just above the channel 12, as in the cooling equipment shown in FIG. 9. The foam-injecting nozzles 16 are directed to the points intermediate between the side end portions A and the side guides 13.

The second embodiment of the present invention is not limited to the above-mentioned methods. For example, there may be adopted a method where, when forming foams, to prevent the surface oxidation of the cooled wire rod, an inert gas such as $N_2$ gas or a reducing gas is used instead of air.

EXAMPLE 3

Figure 11:
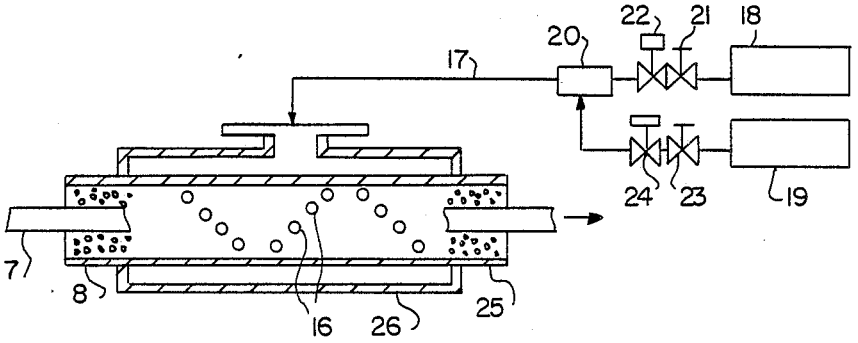

FIG. 11 illustrates an embodiment in which foams are used as the cooling medium in a cooling apparatus heretofore used between rolling stands or after finish rolling.

The cooling apparatus comprises an inner tube 25 and outer tube 26, and injection holes 16 are formed in the inner tube 25. Foams 8 formed in the foam-forming blower 20 in the same manner as described above are introduced and filled in an annular portion between the inner tube 25 and the outer tube 26. The foams 8 in the annular portion are injected into the inner tube 25 through the injection holes 16. The interior of the inner tube 25 is filled with the foams 8 and an agitated state is always maintained by the injected foams 8. A wire rod 7 is cooled while being passed through the foams 8.

In the present example, foams were formed by blowing air having a pressure of 0.5 to 3 kg/cm$^2$ at a rate of about 200 to about 500 l/min while feeding an aqueous solution formed by adding 2.5% by weight of an anionic surface active agent to 1 l of water maintained at normal temperature at a flow rate of about 10 l/min. A rolled steel material containing 0.4% of C and having a diameter of 9.5 mm was cooled at a finish temperature of 950° C. and a feed rate of 30 m/sec in the cooling apparatus, using the so-formed foams as the cooling medium. The wire rod was uniformly and stably cooled at an aimed cooling speed of 20° to 100° C./sec, and a wire rod having an aimed quality was stably prepared.

The present invention is not limited to the above-mentioned embodiments. For example, a steel bar, a steel section, a steel sheet and a strip can be cooled, instead of the above-mentioned wire rod, between rolling stands or after final finish rolling according to the method of the present invention. Moreover, for the formation of foams, an inert gas such as $N_2$ gas or a reducing gas can be blown, instead of air, into the aqueous solution, to prevent a surface oxidation of a cooled steel material.

The present invention and two comparisons, that is, air-blast cooling (Stelmore) and hot water immersion cooling (EDC), were examined with respect to the lot deviation ($\sigma$) of the tensile strength (Ts) in a hard steel wire rod (0.8% C) having a diameter of 10 mm. The results are shown in Table 1.

TABLE 1

| | Ts (kg/mm$^2$) | $\sigma$ |
|---|---|---|
| Stelmore | 120 | 1.35 |
| EDC | 123 | 1.07 |
| Present Invention | 120 | 0.90 |

In the test of the present invention, the foams were supplied so that a cooling speed of 10° C./sec was attained, and an aqueous solution formed by adding 1.0% by weight of a surface active agent to 1 l of water at normal temperature was used for forming foams.

From Table 1, it is seen that the material cooled according to the method of the present invention has an excellent uniform cooling property.

As is apparent from the foregoing description, according to the present invention, since foams formed from an aqueous solution containing a surface active agent or a water-soluble polymer are used as the cooling medium, the formed foams are homogeneous and stable and a layer of uniform foams having a desired water content can be optionally formed, whereby a steel material having an aimed property can be stably prepared with a reduced quality or lot deviation.

More specifically, the method of the present invention is advantageous over the conventional method where air is blown to a steel material for cooling the steel material, in that a uniform cooling is attained. Moreover, the method of the present invention is advantageous over the conventional method where a steel material is immersed and cooled in a strongly stirred warm liquid, in that the passage resistance is small; even a wire rod having such a small diameter as 5.5 mm can be passed through the cooling system in a good condition, peeling of scale is not caused and a surface roughening by pickling is prevented. Furthermore, a treatment of the cooling medium, a vapor-discharging apparatus and a cooling medium recycle apparatus are not necessary in the present invention, and the structure of cooling equipment can be simplified and the equipment can be greatly reduced.

Still further, according to the present invention, since at least one of the blowing ratio and the foam supply rate can be adjusted, the cooling speed can be controlled over a board range. Namely, cooling speeds within ranges attainable by natural gradual cooling, air-blast cooling, water cooling and cooling by a strongly stirred fluid cooling medium of a gas and warm water can be obtained by using one cooling medium (foams). The method of the present invention is advantageous over the conventional methods in that the mechanical properties, such as the tensile strength, of a steel material, can be adjusted over a board range by using one cooling equipment or one cooling medium.

Note, the present invention can be applied not only to the case where an entire hot steel material is uniformly cooled but also to the case where the cooling speed is locally adjusted by changing the blowing ratio or foam feed rate according to the point of the steel material (for example, the central part or end portion).

INDUSTRIAL APPLICABILITY

As apparent from the foregoing illustration, the present invention can be widely and effectively applied to a heat treatment of a rolled steel material, especially a cooling treatment of a hot steel material.

We claim:

1. A method for cooling a rolled steel material, which comprises immersing a hot-rolled steel material in foams obtained by adding a blowing agent to water, which foams have a water content of 0.01 to 80 g/100 ml, to cool the steel material by the foams.

2. A cooling method according to claim 1, wherein the rolled steel material is a ring-shaped high-temperature wire rod.

3. A cooling method according to claim 1, wherein the blowing agent comprises at least one member selected from surface active agents and water-soluble polymers.

4. A cooling method according to claim 1, wherein the foams are supplied to the hot-rolled steel material between rolling stands or after a final finish rolling machine treatment.

5. A cooling method according to claim 1, wherein rolled steel material is cooled while controlling at least one of the temperature of the foams, the ratio of the volume of the foams to the volume of the foam-forming aqueous solution and the feed rate of the foams per unit area and unit time.

6. A cooling method according to claim 2, wherein the foams are supplied in a larger amount to a portion having a large lapping density in the ring-shaped high-temperature wire rod than to a portion having a smaller lapping density.

* * * * *

UNITED STATES PATENT AND TRADEMARK OFFICE

CERTIFICATE OF CORRECTION

PATENT NO. : 4,931,108

DATED : June 5, 1990

INVENTOR(S) : Norio ANZAWA et al.

It is certified that error appears in the above-identified patent and that said Letters Patent is hereby corrected as shown below:

On title page, item [30] Foreign Application Priority Data, for the third priority application, change "September 4, 1987" to read --September 4, 1986--

Signed and Sealed this

Eighteenth Day of January, 1994

*Attest:*

*Attesting Officer*

Bruce Lehman

BRUCE LEHMAN

*Commissioner of Patents and Trademarks*